United States Patent [19]

Derosier

[11] 4,399,664

[45] Aug. 23, 1983

[54] HEAT PUMP WATER HEATER CIRCUIT

[75] Inventor: Gregory S. Derosier, Holmen, Wis.

[73] Assignee: The Trane Company, La Crosse, Wis.

[21] Appl. No.: 327,858

[22] Filed: Dec. 7, 1981

[51] Int. Cl.[3] ..... F25B 27/02

[52] U.S. Cl. ..... 62/238.7; 62/238.6; 62/324.4

[58] Field of Search ..... 62/238.6, 238.7, 324.4

[56] References Cited

U.S. PATENT DOCUMENTS

| | | | |
|---|---|---|---|
| 3,916,638 | 11/1975 | Schmidt | 62/238.6 |
| 4,098,092 | 7/1978 | Singh | 62/238.6 |
| 4,142,379 | 3/1979 | Kuklinski | 62/238.6 |
| 4,249,390 | 2/1981 | Jones | 62/238.6 |
| 4,299,098 | 11/1981 | Derosier | 62/238.6 |
| 4,356,706 | 11/1982 | Baumgarten | 62/238.6 |

*Primary Examiner*—Lloyd L. King

*Attorney, Agent, or Firm*—Carl M. Lewis; Ronald M. Anderson; Raymond W. Campbell

[57] ABSTRACT

A heat pump refrigeration circuit for heating a space, cooling a space, heating a liquid, heating a space and heating a liquid or for cooling a space and heating a liquid in which indoor and outdoor heat exchangers, a liquid heat exchanger and liquid supply means, compressor, conduit and valve means are provided. The liquid heat exchanger is disposed in the hot vapor line, and liquid is circulated therethrough when liquid heating is required. The liquid heat exchanger may be used as a desuperheater or as a condenser, and the indoor and outdoor heat exchangers may be used as condensers or evaporators, depending upon the path of refrigerant flow, as determined by the valve positions. Bypassed heat exchangers are vented to compressor suction for maintaining refrigerant charge control.

20 Claims, 7 Drawing Figures

HEAT PUMP WATER HEATER CIRCUIT

TECHNICAL FIELD

The invention disclosed herein relates broadly to the field of refrigeration and more particularly to the field of heat pumps for heating or cooling a space. Specifically, the invention pertains to an improved refrigeration circuit for heating or cooling a space, for heating or cooling a space while simultaneously heating a liquid and for heating liquid without modifying the air in a space.

BACKGROUND ART

It is known in the art to provide reversible refrigeration devices, known as heat pumps, for heating or cooling the air in a space. It is also known in the art to use a refrigeration circuit for heating a liquid such as water for domestic or other purposes. It has been further proposed to combine the functions of temperature conditioning and water heating in a single refrigeration system, thereby obtaining advantages of both in one unit. For example, U.S. Pat. No. 4,249,390 discloses a system in which water is heated when a space is cooled, and in which, under some conditions, water is heated when the space is heated. The system apparently is not capable of heating water alone, nor of cooling the space without heating water. U.S. Pat. No. 3,916,638 discloses a heat pump which may be used to heat water for domestic purposes when the heat pump is operated to cool a space, or the heat pump can be used to cool a space without heating the domestic water supply. In the space heating mode the auxiliary water supply heat exchanger is bypassed.

A Refrigeration Circuit For Heat Pump Water Heater and Control Therefore are disclosed in my U.S. Pat. No. 4,299,098. The circuit disclosed therein has four operating modes: one for heating a space; one for cooling a space; one for heating the liquid without modifying the air in the space; and one for cooling a space and heating a liquid. As with other refrigeration circuits combining heat pump and water heater operations, the circuit disclosed in my above-cited patent does not include the simultaneous functions of heating the space and heating the liquid.

SUMMARY OF THE INVENTION

It is therefore one of the principal objects of the present invention to provide a refrigeration circuit for a heat pump water heater which can be used to heat a space, to cool a space, or to heat a liquid; and which can be used to simultaneously heat a liquid and cool a space, or to simultaneously heat a liquid and heat a space.

Another object of the present invention is to provide a heat pump water heater refrigeration circuit which uses a refrigerant-to-liquid heat exchanger as either a condenser or as a desuperheater in different modes of operation, and which vents bypassed heat exchangers to the suction side of the compressor for maintaining refrigerant charge control in the circuit.

These and other objects are achieved in the present invention by providing a refrigerant compressor, indoor and outdoor heat exchangers, a refrigerant-to-liquid heat exchanger, liquid supply means, and a refrigerant conduit network including valve means for directing refrigerant flow so that the indoor and outdoor heat exchangers may each be used as a condenser or as an evaporator. The refrigerant-to-liquid heat exchanger is disposed in the hot vapor conduit and can be used as a desuperheater or as a condenser when a liquid is circulated therethrough in heat exchange relationship with the refrigerant. Inoperative heat exchangers in any operating mode are vented to the suction side of the compressor to maintain proper refrigerant charge. The circuit of the present invention has six operating modes briefly summarized below.

In the first mode of operation, for heating a space without heating the liquid for discharge refrigerant vapor from the compressor flows through the refrigerant-to-liquid heat exchanger without the liquid circulating therethrough. The discharge refrigerant from the refrigerant-to-liquid heat exchanger is directed by the valve means to the indoor heat exchanger which functions as a condenser and from the indoor heat exchanger to the outdoor heat exchanger which functions as an evaporator.

In the second mode of operation, for heating the space and having a liquid, the path of refrigerant flow is similar to that summarized above for mode one. The liquid supply means is activated to circulate liquid through the refrigerant-to-liquid heat exchanger, and the refrigerant vapor may or may not be desuperheated in the refrigerant-to-liquid heat exchanger, but in any case the refrigerant is not totally condensed.

In the third mode of operation, for cooling the space without heating a liquid, the hot discharge vapor from the compressor flows through the refrigerant-to-liquid heat exchanger, again without liquid being circulated therethrough. The still hot vapor is directed by the valve means to the outdoor heat exchanger which operates as a condenser and then to the indoor heat exchanger which operates as an evaporator.

In the fourth mode of operation, for cooling the space and heating the liquid, the refrigerant flow is similar to that summarized for mode three. The liquid supply means is activated to circulate liquid through the refrigerant-to-liquid heat exchanger.

In the fifth mode of operation, which is an alternative means for cooling the space and heating the liquid, the refrigerant-to-liquid heat exchanger operates as a condenser. A variable compressor can be used so that, at low compressor speed, the refrigerant-to-liquid heat exchanger operates as a condenser, or, alternatively, a second refrigerant-to-liquid heat exchanger in series with the first refrigerant-to-liquid heat exchanger can be used. The condensed refrigerant flows to the indoor heat exchanger which functions as an evaporator, and the cool refrigerant vapor flows therefrom to the compressor suction. The outdoor heat exchanger is bypassed in this mode.

In the sixth mode, for heating the liquid without heating or cooling the space, the outdoor heat exchanger is used as an evaporator, and the indoor heat exchanger is bypassed. The refrigerant-to-liquid heat exchanger, with our without the optional heat exchanger, operates as a condenser.

When any of the heat exchangers, including the indoor and outdoor heat exchangers, and the optional refrigerant-to-liquid heat exchanger, is operatively excluded from the circuit, the excluded heat exchanger is connected via the conduit and valve means to the compressor suction for maintaining proper refrigerant charge control in the circuit.

Additional objects and advantages of the present invention will become apparent from the detailed description and the accompanying drawings.

DETAILED DESCRIPTION OF THE PREFERRED EMBODIMENT

Figure 1:
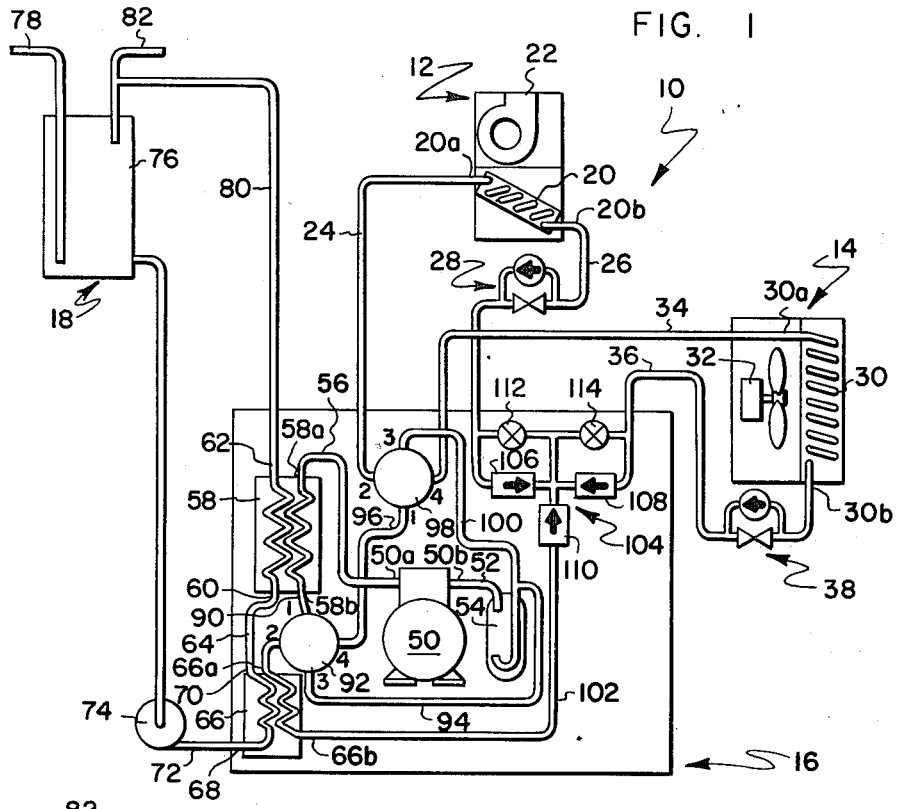
FIG. 1 is a schematic diagram of a heat pump water heater circuit embodying the present invention.

Referring now more specifically to the drawings, and to FIG. 1 in particular, numeral 10 designates a heat pump water heater circuit embodying the present invention which can be used for heating a space, cooling a space, or heating a liquid; or for simultaneously heating a space and heating a liquid, or cooling a space and heating a liquid. It is contemplated that one of the primary uses of the present heat pump water heater circuit will be for heating water for domestic use; however, it should be understood that other liquids may be heated in the circuit embodying the present invention, and references herein to water or water systems should be understood to relate equally to other liquids heated by the circuit. The heat pump water heater circuit includes an indoor heat exchanger assembly 12, an outdoor heat exchanger assembly 14, a compressor and water heater assembly 16, and a water supply and holding means 18.

Indoor heat exchanger assembly 12 is of conventional design and includes a coil 20 having first and second refrigerant flow connections 20*a* and 20*b*. A fan means 22 is provided for circulating air through the heat exchanger. Refrigerant conduits 24 and 26 extend from refrigerant flow connections 20*a* and 20*b*, respectively, to the compressor and water heater assembly 16. An expansion/bypass valve 28 is disposed in conduit 26.

Outdoor heat exchanger assembly 14 is also of conventional design, including a coil 30, having first and second refrigerant flow connections 30*a* and 30*b*. A fan means 32 is provided for circulating air through the heat exchanger. Refrigerant conduits 34 and 36 extend from refrigerant flow connections 30*a* and 30*b*, respectively, to the compressor and water heater assembly 16. An expansion/bypass valve 38 is disposed in conduit 36.

Compressor and water heating assembly 16 includes a compressor 50 having a discharge port 50*a* and a suction port 50*b*. A refrigerant conduit 52 extends from a suction accumulator 54 to suction port 50*b* of the compressor, and a refrigerant conduit 56 extends from the discharge port 50*a* to a refrigerator-to-liquid heat exchanger 58. The refrigerant-to-liquid heat exchanger includes an inlet 58*a* and an outlet 58*b* through which the refrigerant flows into and out of the heat exchanger, respectively, and further includes liquid flow connections 60 and 62 for supplying liquid to the refrigerant-to-liquid heat exchanger. The first liquid flow connection 60 is connected to a liquid supply conduit 64.

An optional refrigerant-to-liquid heat exchanger 66 may be provided having a refrigerant inlet and a refrigerant outlet 66*a* and 66*b*, respectively. The optional heat exchanger is connected for series operation with the first-mentioned refrigerant-to-liquid heat exchanger. Thus, when the optional heat exchanger is used, refrigerant outlet 58*b* is placed in flow communication with refrigerant inlet 66*a*, and the discharge refrigerant from liquid heat exchanger 58 flows into the optional heat exchanger. Liquid flow connections 68 and 70 are provided for the optional heat exchanger, to connect the liquid heat exchangers in series for liquid flow. Connection 70 is connected to liquid conduit 64, and a liquid conduit 72, having a pump 74 disposed therein, connects the optional heat exchanger at connection 68 to a liquid storage tank 76. The tank is provided with a supply of the liquid being heated in the refrigeration circuit through a liquid supply conduit 78. A hot liquid return conduit 80 is disposed between liquid flow connection 62 and tank 76. Distribution conduit 82 is provided from storage tank 76 to distribute the heated liquid, such as hot water for domestic purposes, to the location of use for the heated liquid.

A refrigerant conduit 90 is disposed between refrigerant-to-liquid heat exchanger 58 and a first four-way valve 92. The four-way valve may be of conventional design commonly used in heat pump systems, and the valve includes ports 1, 2, 3, and 4 as indicated in FIG. 1. The valve includes a movable element which provides flow communication in one position between ports 1 and 2 and between ports 3 and 4, and in a second position provides flow communication between ports 1 and 4 and between ports 2 and 3. Port 1 is connected to refrigerant conduit 90 from heat exchanger 58. Port 2 is connected to the refrigerant tube in optional heat exchanger 66, being connected thereto at refrigerant inlet 66*a*. Port 3 is connected to a refrigerant conduit 94 disposed between the first four-way valve and accumulator 54, and port 4 of first four-way valve 92 is connected to a refrigerant conduit 96 disposed between the first four-way valve and a second four-way valve 98.

The second four-way valve 98 may be of construction similar to first four-way valve 92, and the valve includes ports indicated by numerals 1, 2, 3, and 4 in FIG. 1. The second four-way valve includes a movable element for placing ports 1 and 2 and ports 3 and 4 in flow communication in a first position, and for placing ports 1 and 4 and ports 2 and 3 in flow communication in a second position. Port 1 of valve 98 is connected to refrigerant conduit 96 extending from port 4 of valve 92. Port 2 of valve 98 is connected to the aforementioned refrigerant conduit 24 extending to refrigerant flow connection 20*a* of coil 20. Port 3 of valve 98 is connected to a conduit 100 extending between the second four-way valve and suction accumulator 54, and port 4 of four-way valve 98 is connected to the aforementioned refrigerant conduit 34 from refrigerant flow connection 30*a* of coil 30. Thus, the arrangement of tion side of compressor 50. As in the previously described operating modes, optional heat exchanger 66 is connected to the suction side of the compressor via ports 2 and 3 of first four-way valve 92, and the heat exchanger is sealed by check valve 110, thereby creating a siphoning effect for maintaining refrigerant charge control in the circuit.

Figure 4:
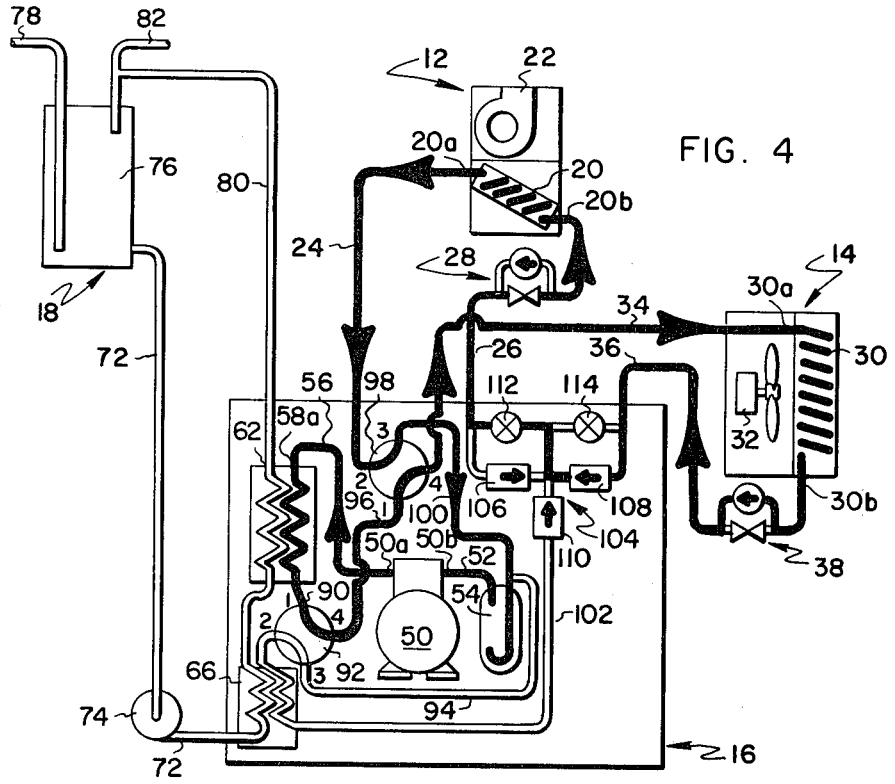
FIG. 4 is a schematic diagram showing in bold lines the flow of refrigerant for cooling a space without heating a liquid.
Figure 5:
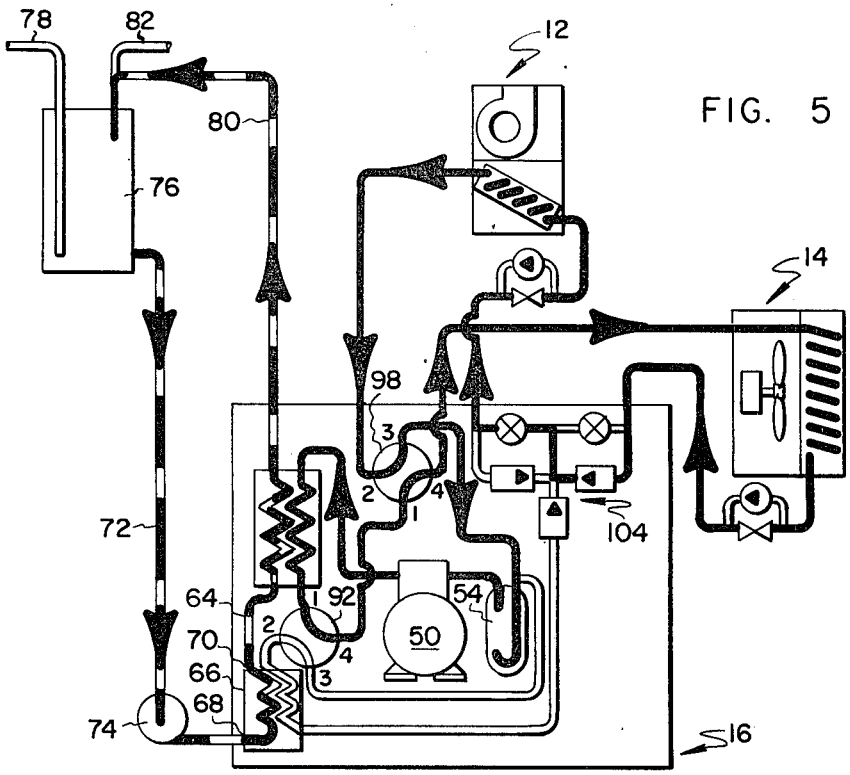
FIG. 5 is a schematic diagram showing in bold lines the flow of refrigerant for cooling a space and heating a liquid, and showing the flow of the liquid in broken lines.
Figure 6:
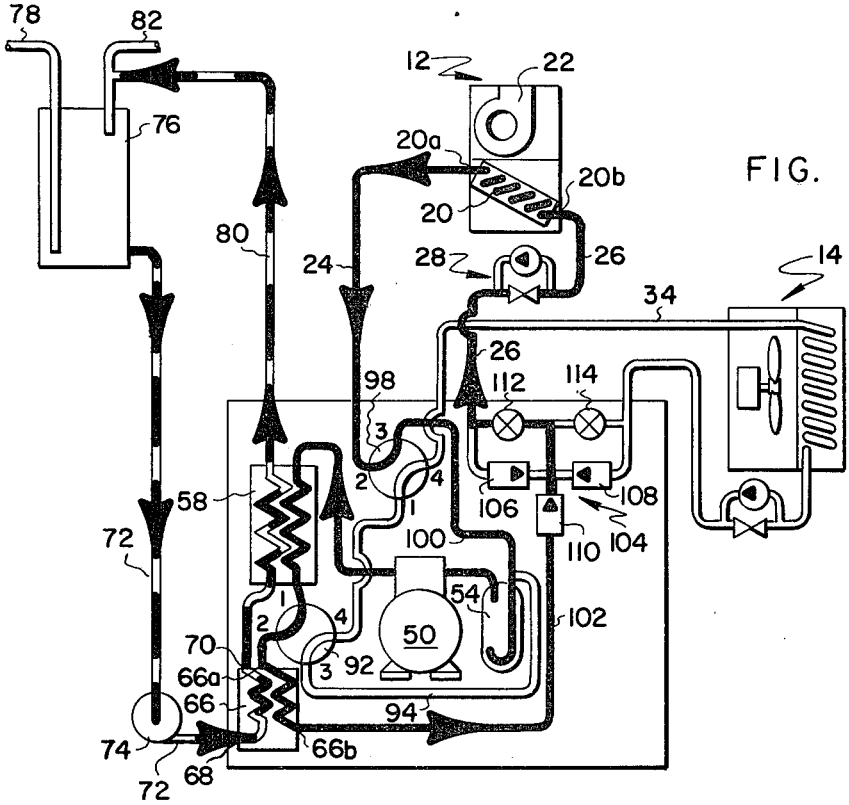
FIG. 6 is a schematic diagram showing in bold lines the flow of refrigerant for an optional method of cooling a space and heating a liquid, and showing the flow of liquid in broken lines.

Turning now to FIG. 5, the fourth mode of operation will be described, wherein the indoor space is cooled while a liquid is heated simultaneously. The flow of refrigerant is identical to that described with reference to FIG. 4 and mode 3; however, in mode 4, pump 74 is actuated to circulate liquid from tank 76 to the refrigerant-to-liquid heat exchangers. Again, the hot refrigerant vapor may, or may not, be desuperheated in the refrigerant-to-liquid heat exchangers, but the vapor is not completely condensed and therefore, the outdoor heat exchanger is required for operating as a condenser in the circuit.

With reference now to FIG. 5, an optional mode for cooling the room and simultaneously heating a liquid will be described. In this optional mode, designated herein as mode 5, the refrigerant-to-liquid heat exchanger, or heat exchangers, operate as a condenser. Thus, the outdoor heat exchanger may be bypassed. This mode is beneficial when large volumes of heated liquid are required, such as when the demand is great through distribution conduit 82. When the optional refrigerant-to-liquid heat exchanger 66 is used, four-way valve 92 is adjusted so that ports 1 and 2 are in flow communication, and ports 3 and 4 are in flow communication. Hence, the refrigerant discharged from heat exchanger 58 flows through four-way valve 92 to heat exchanger 66, wherein it is condensed. The condensed refrigerant flows through conduit 102 to the solenoid/-check valve assembly, wherein check valve 110 permits flow therethrough, and solenoid valve 112 is opened, permitting the refrigerant to flow into conduit 26. The refrigerant then flows through the expansion side of expansion/bypass valve 28 and into refrigerant flow connection **20*b* of coil 20 which operates as an evaporator. The cool vapor from coil 20 flows through conduit 24 to second four-way valve 98 at port 2, which is in flow communication with port 3 in mode 5 operation, and the refrigerant vapor flows through conduit 100 to suction accumulator 54. It should be noted that although outdoor heat exchanger 14 is bypassed in mode 5, the sealing effect of check valve 108 and solenoid valve 114, and the siphoning effect through ports 1 and 4 of four-way valve 98 and ports 3 and 4 of four-way valve 92** connect the outdoor heat exchanger to the suction side of the compressor for maintaining refrigerant charge control in the circuit.

Under some conditions it may be preferable to use a variable compressor in the circuit, rather than the optional heat exchanger. When operating the circuit in mode 5, wherein the refrigerant-to-liquid heat exchanger operates as a condenser, the compressor is operated at low speed. In this situation, the optional heat exchanger can be eliminated. Valve 92 directs refrigerant discharged from liquid heat exchanger 58 either to four-way valve 98 or to solenoid/check valve assembly 104 for varying the path of the refrigerant flow as the liquid heat exchanger is used as a desuperheater or as a condenser.

Figure 7:
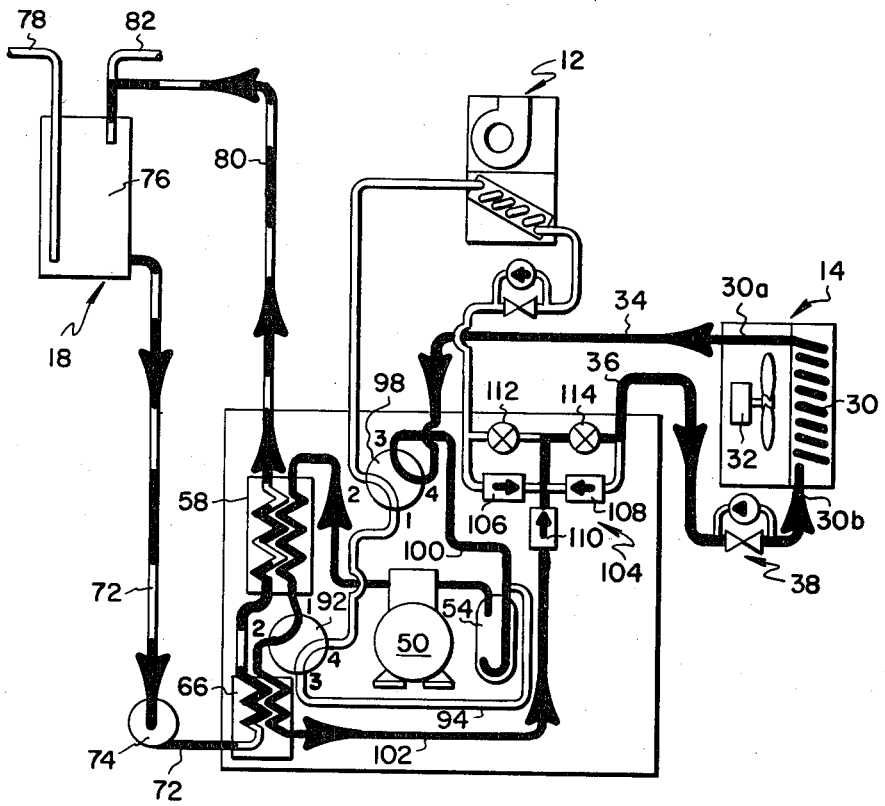
FIG. 7 is a schematic diagram showing in bold lines the flow of refrigerant for heating a liquid only, without temperature modification to the air in the space, and showing the flow of the fluid in broken lines.

With reference now to FIG. 7, the final mode of operation will be described wherein the liquid is heated using the outdoor heat exchanger as an evaporator, and thereby not influencing the temperature of the indoor space. The hot vapor from compressor 50 flows through the refrigerant-to-liquid heat exchanger 58 wherein liquid is circulated by pump 74. First four-way valve 92 is adjusted so that ports 1 and 2 are in flow communication and ports 3 and 4 are in flow communication. Thus, the discharged refrigerant from heat exchanger 58 flows through the first four-way valve to heat exchanger 66, and the condensed refrigerant therefrom flows through conduit 102 to solenoid check valve assembly 104. Check valve 110 permits flow therethrough, and solenoid valve 114 is opened, permitting flow of refrigerant through conduit 36 and the expansion side of expansion/bypass valve 38 to coil 30, which operates as an evaporator. The cool refrigerant vapor flows through conduit 34, ports 4 and 3 of second four-way valve 98 and through conduit 100 to the suction accumulator 54. No temperature modification occurs in the indoor space in that the indoor heat exchanger assembly 12 is bypassed by the circulating refrigerant. The sealing effect of check valve 106 and solenoid valve 112, and the siphoning effect through ports 2 and 1 of four-way valve 98 and through ports 4 and 3 of four-way valve 92 maintain refrigerant charge control by connecting the indoor heat exchanger via conduit 94 to the suction side of the compressor.

As with mode 5, a variable compressor and the alternate conduit arrangement can be used in mode 6. Liquid heat exchanger 58 can then be used as a condenser, without the optional liquid heat exchanger.

Thus, the present heat pump water heater circuit provides means for heating or cooling a space, for heating or cooling a space while simultaneously heating a liquid, and for heating a liquid without influencing the temperature of the indoor space. The circuit provides for siphoning of bypassed heat exchangers to maintain refrigerant charge control through the circuit in each operating mode.

Although one embodiment of a heat pump water heater circuit has been shown and described in detail herein, various changes may be made without departing from the scope of the present invention.

I claim:

1. A refrigeration circuit comprising an indoor heat exchanger having first and second refrigerant flow connections; an outdoor heat exchanger having first and second flow connections; a compressor having a suction port and a discharge port; a liquid heat exchanger having a refrigerant inlet in communication with said compressor discharge and having a refrigerant outlet; and conduit and valve means for selectively placing said flow connections, said suction port and said refrigerant outlet in flow communication by different conduit paths, including a. a first path wherein said refrigerant outlet of said liquid heat exchanger is connected to said first flow connection of said indoor heat exchanger, said second flow connection of said indoor heat exchanger is connected to said second flow connection of said outdoor heat exchanger, and said first flow connection of said outdoor heat exchanger is connected to said compressor suction port;

b. a second path wherein said refrigerant outlet is connected to said first flow connection of said outdoor heat exchanger, said second flow connection of said outdoor heat exchanger is connected to said second flow connection of said indoor heat exchanger, and said first flow connection of said refrigerant flow conduits and the first and second four-way valves is such that the refrigerant from heat exchanger 58, flowing into the first four-way valve at port 1 thereof, can be directed to flow into the optional heat exchanger in a first valve position or into the second four-way valve in a second valve position. The refrigerant flowing into the second four-way valve at port 1 thereof can be directed to flow from the second four-way valve into refrigerant flow connection 20*a* of coil 20 or into the refrigerant flow connection 30*a* of coil 30 in a second valve position.

Refrigerant outlet 66*b* of optional refrigerant-to-liquid heat exchanger 66 is connected by a conduit 102 to a solenoid/check valve assembly 104. Conduits 26 and 36 from refrigerant flow connections 20*b* and 30*b*, respectively, are also connected to the solenoid/check valve assembly. The solenoid/check valve assembly includes check valves 106, 108, and 110 and solenoid valves 112 and 114 which interconnect refrigerant flow connections 20*b*, 30*b*, and 66*b*, to direct flow. Specifically, check valve 106 prevents flow into coil 20 through refrigerant flow connection 20*b*. Check valve 108 prevents flow into coil 30 through refrigerant flow connection 30*b*, and check valve 110 presents flow into coil 66 through outlet 66*b*. Solenoid valves 112 and 114 are disposed in parallel with check valves 106 and 108, respectively, to selectively direct the flow of refrigerant entering the valve assembly to the aforementioned second refrigerant flow connections of coils 20 and 30.

In the use and operation of a heat pump water heating refrigeration circuit embodying the present invention, four-way valves 92 and 98 are selectively positioned in either their first or second positions, and the solenoid valves are selectively opened or closed to direct refrigerant flow for the particular mode of operation desired. Each of the six operating modes will be described fully, with reference to FIGS. 2 through 7, accordingly.

Figure 2:
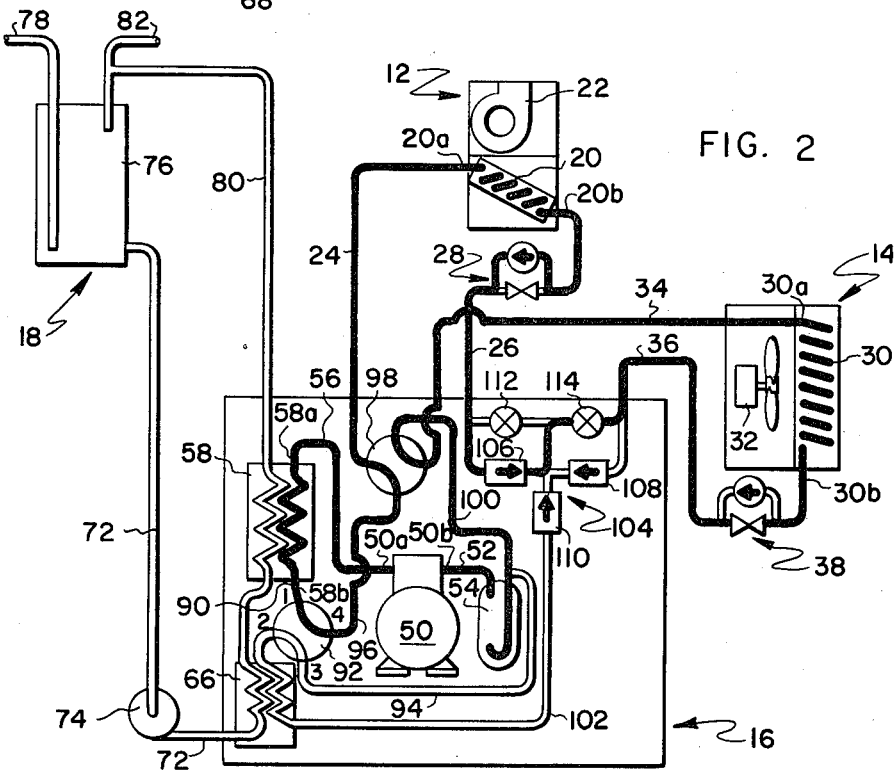
FIG. 2 is a schematic diagram of the circuit showing in bold lines the flow of refrigerant for heating a space without heating a liquid.

In the first mode of operation, shown schematically in FIG. 2, wherein the space is heated and no liquid heating occurs, discharge vapor from compressor 50 flows through refrigerant conduit 56 to heat exchanger 58. Pump 74 of the liquid supply and holding means is inactive, so that no liquid circulates through the heat exchanger. The still-hot refrigerant vapor passes from heat exchanger 58 to conduit 90 and into four-way valve 92 through port 1 thereof. Valve 92 is positioned so that ports 1 and 4 are in flow communication, and the refrigerant flowing into the valve flows from the four-way valve through conduit 96 to second four-way valve 98. The second four-way valve is in the position such that ports 1 and 2 are in communication, and the refrigerant flows from the second four-way valve to coil 20 through conduit 24. The hot vapor in coil 20 relinquishes heat to air flowing through heat exchanger assembly 20, circulated by fans means 22. The indoor heat exchanger thus operates as a condenser, and the liquid refrigerant flowing therefrom flows through the bypass of expansion/bypass valve 28 and through conduit 26 to the solenoid/check valve assembly 104. Check valve 106 of the assembly permits the fluid to flow therethrough, and solenoid valve 114 is opened to permit flow into conduit 36. The refrigerant flows through the expansion side of expansion/bypass valve 38 and through coil 30 which functions as an evaporator. The cool refrigerant vapor flows through conduit 34 to four-way valve 98, entering the four-way valve at port 4 and flowing from the four-way valve at port 3, entering conduit 100 and flowing to suction accumulator 54, completing the circuit to suction port 50*b* of compressor 50. The sealing effect of check valve 110 in conduit 102 permits siphoning of the optional heat exchanger 66 through ports 2 and 3 of first four-way valve 92 which communicate with the suction side of the compressor through conduit 94.

Figure 3:
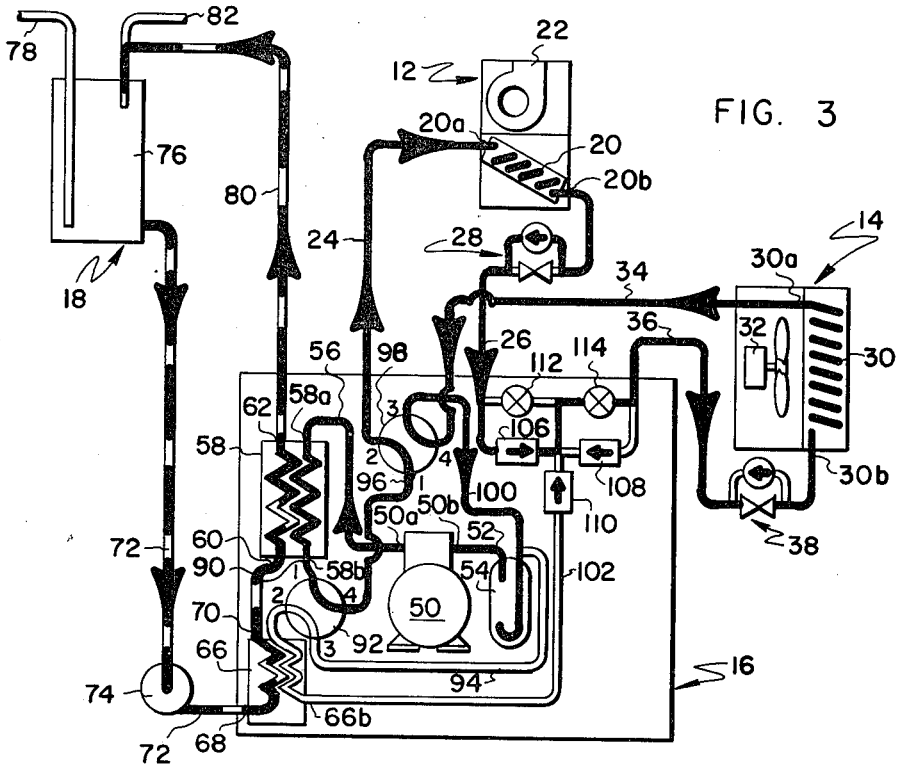
FIG. 3 is a schematic diagram showing in bold lines the flow of refrigerant for heating the space and heating the liquid, and showing the flow of the liquid in broken lines.

With reference now to FIG. 3 the second mode of operation will be described wherein the indoor space is heated, and a liquid is heated as well. The refrigerant flow circuit is identical in mode 2 to that described for mode 1. In the second mode, however, pump 74 is activated to circulate liquid from tank 76 through conduit 72 to the refrigerant-to-liquid heat exchangers. If the optional heat exchanger 66 is used in the circuit, it is bypassed by the refrigerant in mode 2, and the liquid flows therethrough without passing in heat exchange relationship with the refrigerant. The liquid from the optional heat exchanger passes through liquid conduit 64 to refrigerant-to-liquid heat exchanger 58, and flowing through the heat exchanger, the liquid passes in heat exchange relationship with the superheated refrigerant. Heat is transferred from the superheated refrigerant to the liquid, and the liquid flows from the heat exchanger through conduit 90 to holding tank 76. The refrigerant flowing through the refrigerant-to-liquid heat exchanger may, or may not be desuperheated or partly condensed by the heat transfer to the liquid; however, the refrigerant is not, in any case, completing condensed in the refrigerant-to-liquid heat exchanger during operation in mode 2. Hence, the still-hot, and perhaps superheated vapor flows from the refrigerant-to-liquid heat exchanger through first four-way valve 92 to second four-way valve 98, to complete the refrigerant circuit as described for mode 1 operation. The optional heat exchanger 66 is sealed by check valve 110 and siphoned through first four-way valve 92 to the suction side of the compressor to maintain refrigerant charge control in the circuit as described previously.

Operation of the present invention in mode 3, for cooling the indoor space without heating the liquid, will now be described with reference particularly to FIG. 4. Four-way valve 92 remains in the position described for the previous modes; however, second four-way valve 98 is adjusted to its second position wherein port 1 is in flow communication with port 4, and port 2 is in flow communication with port 3. Hence, the hot refrigerant vapor from compressor 50 flows through the refrigerant-to-liquid heat exchanger, which does not have liquid flowing therethrough in that pump 74 is inactive, and the vapor flows from the refrigerant-to-liquid heat exchanger through conduit 90, first four-way valve 92 and conduit 96 to second four-way valve 98. From the second four-way valve the refrigerant flows through conduit 34 to outdoor heat exchanger assembly 14 which operates as a condenser. The liquid refrigerant flowing from refrigerant flow connection 30*b* of coil 30 flows through conduit 36 to the solenoid/check valve assembly 104, wherein check valve 108 permits flow therethrough, and solenoid valve 112 is opened, permitting the refrigerant liquid to flow into conduit 26. The refrigerant flows through the expansion side of expansion/bypass valve assembly 28 and into coil 20 through refrigerant flow connection 20*b*. The indoor heat exchanger operates as an evaporator, and cool refrigerant vapor from the indoor heat exchanger flows through conduit 24 to four-way valve 98, entering at port 2. The cool refrigerant vapor flows therefrom through port 3 and conduit 100 to suction accumulator 54 and the sucindoor heat exchanger is connected to said compressor suction port;

c. a third path wherein said refrigerant outlet is connected to said second flow connection of said indoor heat exchanger, said first flow connection of said indoor heat exchanger is connected to said compressor suction port, said second flow connection of said outdoor heat exchanger is effectively closed, and said first flow connection of said outdoor heat exchanger is connected to said compressor suction port; and d. a fourth path wherein said refrigerant outlet is connected to said second flow connection of said outdoor heat exchanger, said first flow connection of said outdoor heat exchanger is connected to said compressor suction port, and second flow connection of said indoor heat exchanger is effectively closed, and said first flow connection of said indoor heat exchanger is connected to said compressor suction port.

2. A refrigeration circuit as defined in claim 1 in which said compressor is a variable compressor.

3. A refrigeration circuit as defined in claim 1 in which a second refrigerant-to-liquid heat exchanger is disposed in the circuit and includes a refrigerant inlet and a refrigerant outlet connected to said conduit and valve means for communication with said flow connections, said suction port and said outlet of said first-mentioned liquid heat exchanger; wherein a. in said first and second paths said outlet of said second liquid heat exchanger is effectively closed, and said inlet of said second liquid heat exchanger is connected to said compressor suction port;

b. in said third path said inlet of said second liquid heat exchanger is connected to said outlet of said first liquid heat exchanger, and said outlet of said second liquid heat exchanger is connected to said second flow connection of said indoor heat exchanger; and c. in said fourth path said inlet of said second liquid heat exchanger is connected to said outlet of said first liquid heat exchanger, and said outlet of said second liquid heat exchanger is connected to said second flow connection of said outdoor heat exchanger.

4. A refrigeration circuit comprising an indoor heat exchanger for transferring heat between a refrigerant flowing therethrough and the air in a space, said indoor heat exchanger including first and second refrigerant flow connections; an outdoor heat exchanger for transferring heat between a refrigerant flowing therethrough and the ambient, said outdoor heat exchanger including first and second refrigerant flow connections; a compressor for compressing refrigerant in the circuit, said compressor including a discharge port and a suction port; a refrigerant-to-liquid heat exchanger for transferring heat from a refrigerant to a liquid, said liquid heat exchanger including a refrigerant inlet in flow communication with said compressor discharge port and a refrigerant outlet; first conduit means and first valve means for selectively connecting said refrigerant outlet and said first flow connections of said indoor and outdoor heat exchangers; second conduit means and second valve means for connecting said second flow connections of said indoor and outdoor heat exchangers and said compressor suction port; and third valve means for selectively connecting said refrigerant outlet to said first and second conduit and valve means; said valve means directing refrigerant for operating said circuit in:

i. a first mode wherein hot refrigerant vapor from said refrigerant outlet is directed to said first flow connection of said indoor heat exchanger, liquid refrigerant is directed from said second flow connection of said indoor heat exchanger to said second flow connection of said outdoor heat exchanger, and cool refrigerant vapor from said first flow connection of said outdoor heat exchanger is directed to said suction port;

ii. a second mode wherein hot refrigerant vapor from said refrigerant outlet is directed to said first flow connection of said outdoor heat exchanger, liquid refrigerant is directed from said second flow connection of said outdoor heat exchanger to said second flow connection of said indoor heat exchanger, and cool refrigerant vapor is directed from said first flow connection of said indoor heat exchanger to said compressor suction port;

iii. a third mode wherein liquid refrigerant is directed from said refrigerant outlet to said second flow connection of said indoor heat exchanger, and cool refrigerant vapor is directed from said first flow connection of said indoor heat exchanger to said compressor suction port; and iv. a fourth mode wherein liquid refrigerant is directed from said refrigerant outlet to said second flow connection of said outdoor heat exchanger, and cool refrigerant vapor from said first flow connection of said outdoor heat exchanger is directed to said compressor suction port.

5. A refrigeration circuit as defined in claim 4 in which a second refrigerant-to-liquid heat exchanger is provided; said first and third valve means include first and second four-way valves; said first four-way valve being connected in flow communication at a first port with said refrigerant outlet of said first-mentioned refrigerant-to-liquid heat exchanger, at a second port with a refrigerant inlet for said second refrigerant-to-liquid heat exchanger, at a third port with said suction port of said compressor, and at a fourth port with said second four-way valve; said second four-way valve being connected in flow communication at a first port with said fourth port of said first four-way valve, at a second port with said first flow connection of said indoor heat exchanger, at a third port with said compressor suction port, and at a fourth port with said first flow connection of said outdoor heat exchanger; and said four-way valves each including elements for selectively placing the first ports in communication with the second ports and the third ports in communication with the fourth ports in first operating positions, and for placing the first ports in communication with the fourth ports and the second ports in communication with the third ports in second operating positions.

6. A refrigeration circuit as defined in claim 5 in which said second liquid heat exchanger includes a refrigerant outlet connected by a conduit to a solenoid/-check valve assembly; conduits connect said valve assembly to said second flow connections of said indoor and outdoor heat exchangers; check valves are disposed in said conduits for allowing refrigerant to flow from, and for preventing refrigerant to flow to, said second flow connections and said refrigerant outlet of said second liquid heat exchanger; and solenoid valves are provided for selectively passing refrigerant from said valve assembly to said second flow connections.

7. A refrigeration circuit as defined in claim 4 in which said compression is a variable compressor.

8. A refrigeration circuit as defined in claim 4 or 7 in which a conduit is disposed between said second flow connections of said indoor and outdoor heat exchangers; check valves disposed in said conduit limit the flow of refrigerant to flow away from said second flow connections, and solenoid valves in parallel with said check valves selectively allow refrigerant flow toward said second flow connections.

9. A refrigeration circuit comprising an indoor heat exchanger, an outdoor heat exchanger; a compressor having a discharge port and a suction port; a refrigerant-to-liquid heat exchanger; conduit means interconnecting said compressor and said heat exchangers; and valve means for selectively controlling the path of flow communication between said heat exchangers and said compressor, said valve means directing refrigerant flow in at least:

a. a first path wherein said liquid heat exchanger is in flow communication between said compressor discharge port and said indoor heat exchanger, and said outdoor heat exchanger is in flow communication between said indoor heat exchanger and said compressor suction port;

b. a second path wherein said liquid heat exchanger is in flow communication between said compressor discharge port and said outdoor heat exchanger, and said indoor heat exchanger is in flow communication between said outdoor heat exchanger and said compressor suction port;

c. a third path wherein said liquid heat exchanger is in flow communication between said compressor discharge port and said indoor heat exchanger, discharge refrigerant from said indoor heat exchanger is directed to said compressor suction port, and said outdoor heat exchanger is bypassed by refrigerant flow; and d. a fourth path wherein said liquid heat exchanger is in flow communication between said compressor discharge port and said outdoor heat exchanger, discharge refrigerant from said outdoor heat exchanger is directed to said compressor suction port, and said indoor heat exchanger is bypassed by refrigerant flow.

10. A refrigeration circuit as defined in claim 9 in which a second liquid heat exchanger is disposed in the circuit for receiving discharge refrigerant from said first-mentioned liquid heat exchanger; and said valve means includes a valve for selectively directing refrigerant to said second liquid heat exchanger and a valve assembly for directing refrigerant flow in at least:

a. a first path wherein said outdoor heat exchanger is disposed in flow communication between said second liquid heat exchanger and said compressor suction port, and said indoor heat exchanger is bypassed by refrigerant flow; and b. a second path wherein said indoor heat exchanger is disposed in flow communication between said second liquid heat exchanger and said compressor suction port, and said outdoor heat exchanger is bypassed by refrigerant flow.

11. A refrigeration circuit for selectively heating a space, cooling a space, heating a liquid, heating a space and heating a liquid, or cooling a space and heating a liquid, said refrigeration circuit comprising:

a. an indoor heat exchanger for transferring heat between a refrigerant and the air of an indoor space;
   i. first and second refrigerant flow connections in said indoor heat exchanger;

b. an outdoor heat exchanger for transferring heat between a refrigerant and the ambient;
   i. first and second refrigerant flow connections in said outdoor heat exchanger;

c. a refrigerant-to-liquid heat exchanger for transferring heat between a refrigerant and a liquid;
   i. a refrigerant inlet and a refrigerant outlet in said liquid heat exchanger;

d. a compressor having a discharge port and a suction port;
   i. said discharge port being connected to said refrigerant inlet of said liquid heat exchanger;

e. a first conduit means and first valve means interconnecting said second flow connections of said indoor and outdoor heat exchangers and said outlet of said liquid heat exchanger;
   i. check valves disposed in said conduit means permitting refrigerant flow from and preventing refrigerant flow to said second flow connections and said outlet;
   ii. solenoid valves for selectively passing discharge refrigerant from one of said heat exchangers to said second flow connection of said indoor heat exchanger in one operating position, and to said second flow connection of said outdoor heat exchanger in a second operating position;

f. a second conduit means and second valve means interconnecting said first flow connections of said indoor and outdoor heat exchangers and said compressor suction port;
   i. said second valve means having selectively communicable ports for directing refrigerant to said first flow connections of said indoor and outdoor heat exchangers, and for directing refrigerant from said first flow connections to said compressor suction port; and g. a third conduit means and third valve means interconnecting said outlet of said liquid heat exchanger and said first and second valve and conduit means.

12. A refrigeration circuit as defined in claim 11 in which said compressor is a variable compressor.

13. A refrigeration circuit as defined in claim 11 in which a first four-way valve is disposd in said circuit, said four-way valve having:

a. a first port communicating with said refrigerant outlet of said liquid heat exchanger;

b. a second port communicating with a second liquid heat exchanger;

c. a third port communicating with said compressor suction port; and d. a fourth port selectively communicable with said first flow connections of said indoor and outdoor heat exchangers;

and a conduit is disposed from an outlet of said second liquid heat exchanger to said first conduit and valve means.

14. A refrigeration circuit as defined in claim 13 in which a second four-way valve is disposed in said circuit and includes:

a. a first port communicating with said fourth port of said first four-way valve;

b. a second port communicating with said first flow connection of said indoor heat exchanger;

c. a third port communicating with said compressor suction port; and d. a fourth port communicating with said first flow connection of said outdoor heat exchanger.

15. A heat pump refrigeration circuit comprising a compressor having discharge and suction ports; a refrigerant-to-liquid heat exchanger having a refrigerant inlet in flow communication with said discharge port and having a refrigerant outlet; an indoor heat exchanger having first and second refrigerant flow connections; an outdoor heat exchanger having first and second refrigerant flow connections; a first conduit means connecting said refrigerant outlet of said refrigerant-to-liquid heat exchanger in flow communication with said first refrigerant flow connections of said indoor and outdoor heat exchangers; a second conduit means for connecting said second flow connections of said indoor and outdoor heat exchangers, said outlet of said liquid heat exchanger and said suction port; a first valve means for directing refrigerant from said liquid heat exchanger to said first flow connection of said indoor heat exchanger in a first operating position and for directing refrigerant from said liquid heat exchanger to said first flow connection of said outdoor heat exchanger in a second operating position; a second valve means for directing refrigerant from said second flow connection of said indoor heat exchanger to said second flow connection of said outdoor heat exchanger in a first position, for directing refrigerant from said second flow connection of said outdoor heat exchanger to said second flow connection of said indoor heat exchanger in a second position, for directing refrigerant from said outlet to said second flow connection of said outdoor heat exchanger in a third position and to said second flow connection of said indoor heat exchanger in a fourth position; and a third valve means for directing refrigerant flow from said refrigerant outlet of said refrigerant-to-liquid heat exchanger to said second valve means in a first position and to said first valve means in a second position.

16. A heat pump refrigeration circuit as defined in claim 15 in which a second refrigerant-to-liquid heat exchanger having a refrigerant inlet and a refrigerant outlet is provided; said outlet of said second liquid heat exchanger is connected to said second valve means, and said third valve means connects said first liquid heat exchanger outlet to said second liquid heat exchanger inlet in a first position and to said first valve means in a second position.

17. A heat pump refrigeration circuit as defined in claim 16 in which said valve means include a first four-way valve having first, second, third, and fourth ports connected to said first liquid heat exchanger outlet, said second liquid heat exchanger inlet, said compressor suction and a second four-way valve respectively; and said first four-way valve is selectively adjustable to place ports one and two and ports three and four in communication in a first position, and to place ports one and four and ports two and three in communication in a second position.

18. A heat pump refrigeration circuit as defined in claim 17 in which said second four-way valve includes a first port connected to said first flow connection of said indoor heat exchanger, a third port connected to said compressor suction, a fourth port connected to said first flow connection of said outdoor heat exchanger; and element means for interconnecting the first and second ports and the third and fourth ports in a first position and for interconnecting the first and fourth ports and the second and third ports in a second position.

19. A heat pump refrigeration circuit as defined in claim 15 in which said compressor is a variable compressor.

20. A heat pump refrigeration circuit as defined in claim 15 in which a second refrigerant-to-liquid heat exchanger is provided; a first four-way valve is provided having a first port connected to said refrigerant outlet of said first-mentioned refrigerant-to-liquid heat exchanger, a second port connected to a refrigerant inlet of said second refrigerant-to-liquid heat exchanger, a third port connected to said compressor suction, a fourth port connected to said first-mentioned valve means, and element means for placing said first port in flow communication with said second port and said third port in flow communication with said fourth port in a first operating position, and for placing said first port in flow communication with said fourth port and said second port in flow communication with said third port in a second operating position; and a conduit connects a refrigerant outlet of said second refrigerant-to-liquid heat exchanger to said second valve means.

* * * * *

UNITED STATES PATENT AND TRADEMARK OFFICE

CERTIFICATE OF CORRECTION

PATENT NO. : 4,399,664

DATED : August 23, 1983

INVENTOR(S) : Gregory S. Derosier

It is certified that error appears in the above-identified patent and that said Letters Patent are hereby corrected as shown below:

Claim 1, column 9, line 16 "and" should be --said--.

Claim 13, column 12, line 48 "disposd" should be --disposed--.

Signed and Sealed this

First Day of November 1983

[SEAL]

*Attest:*

GERALD J. MOSSINGHOFF

*Attesting Officer*

*Commissioner of Patents and Trademarks*